US005494278A

United States Patent [19]

Linden

[11] Patent Number: 5,494,278

[45] Date of Patent: Feb. 27, 1996

[54] HITTING PRACTICE MACHINE FOR BALL GAMES

[76] Inventor: Craig L. Linden, 1335 Midway Dr., Alpine, Calif. 91901

[21] Appl. No.: 300,659

[22] Filed: Sep. 6, 1994

[51] Int. Cl.[6] ..... A63B 69/40

[52] U.S. Cl. ..... 273/26 E; 273/58 C

[58] Field of Search ..... 273/26 E, 26 R, 273/185 D, 184 B, 187.3, 186.1, 187.3, 190, 197 R, 197 A, 58 G, 58 C, 86 H, 319, 331, 413, 129 AV

[56] References Cited

U.S. PATENT DOCUMENTS

| | | | |
|---|---|---|---|
| 1,074,880 | 10/1913 | Lynch | 273/185 D |
| 2,656,720 | 10/1953 | Sonnett | 273/185 D |
| 3,166,316 | 1/1965 | O'Leary | 273/26 E |
| 3,762,705 | 10/1973 | Gonzalez | 273/26 R |
| 4,042,241 | 8/1977 | Collins | 273/58 C |
| 4,105,203 | 8/1978 | Cho | 273/29 A |
| 4,440,400 | 4/1984 | Neuberger | 273/58 G |
| 4,573,679 | 3/1986 | Janszen | 273/26 E |
| 4,846,472 | 7/1989 | Terza | 273/26 E |
| 5,035,424 | 7/1991 | Liao | 273/185 D |
| 5,184,816 | 2/1993 | Lunsford | 273/26 E |
| 5,203,558 | 4/1993 | An | 273/29 A |
| 5,255,920 | 10/1993 | Mangeri | 273/185 D |

FOREIGN PATENT DOCUMENTS

| | | | |
|---|---|---|---|
| 8704635 | 8/1987 | WIPO | 273/29 A |

*Primary Examiner*—Theatrice Brown
*Attorney, Agent, or Firm*—Brown Martin Haller & McClain

[57] ABSTRACT

A ball hitting practice machine has a movable member and a ball carrying arm secured at one end to the movable member and carrying a ball at its opposite end. The ball carrying arm is at least partially flexible and the ball is permanently tethered to the machine. A drive motor moves the movable member so as to swing the ball on an appropriate path for hitting by a player.

12 Claims, 1 Drawing Sheet

HITTING PRACTICE MACHINE FOR BALL GAMES

BACKGROUND OF THE INVENTION

The present invention relates generally to ball hitting practice devices or machines for use in training individuals to hit balls accurately in various types of ball games, such as baseball, softball, tennis, and the like, and is particularly concerned with a baseball machine.

Some baseball and tennis practice machines propel loose balls repetitively towards a player for ball hitting practice. This has the disadvantage that all the loose balls must be collected and the machine must be refilled periodically. Additionally, the player or trainer may be hit by a propelled or hit ball. Such ball pitchers are also relatively expensive.

SUMMARY OF THE INVENTION

It is an object of the present invention to provide a new and improved hitting practice machine for ball games and sports of the type in which a ball is hit by a club, bat, racket or other hitting implement.

According to the present invention, a hitting practice machine is provided which comprises a movable member, a drive assembly for driving the movable member in a predetermined path, and a ball carried by the movable member for striking by a player. The ball may be of conventional round ball-like shape, or other convenient shapes for hitting with a bat.

Preferably, a resilient shock-absorbing device is provided for absorbing shock on impact with the ball. The movable member may be resilient, or may carry a resilient arm on which the ball is carried. In one embodiment, a flexible tether has one end secured to the movable member, and the ball is secured to the opposite end of the flexible tether, whereby movement of the movable member moves the tethered ball along a predetermined path for striking by a player.

In a preferred embodiment of the invention, the movable member comprises a rotating shaft and a hollow support arm is secured at one end to the shaft and has an outer end on which the ball is either freely supported or secured, the flexible tether extending through the support arm and being secured to the rotating shaft. The flexible tether may comprise a spring, for example, or a flexible cord such as a "bungee" type cord. The support arm may be a rigid tube, with the ball being seated on the outer end of the tube and being propelled away from the tube when hit, with the tether extending out of the tube. Alternatively, the support arm may be a flexible hose and the ball may be secured to the outer end of the hose. In this case, the hose bends when the ball is hit, and subsequently springs back to its normal position.

With this arrangement, a player can repeatedly practice hitting the ball, with the ball being propelled away from the player when hit by extension or bending of the flexible tether, but subsequently springing back into position for hitting again. This avoids the need for ball retrieving during practice, and also avoids the risk of either the trainer or the player being struck by a free ball. The machine will also be significantly less expensive than conventional ball throwing machines, and can be used in a smaller space, indoors or out. This increases the amount of time a player can practice effectively.

BRIEF DESCRIPTION OF THE DRAWINGS

The present invention will be better understood from the following detailed description of some preferred embodiments of the invention, taken in conjunction with the accompanying drawings, in which like reference numerals refer to like parts, and in which.

DESCRIPTION OF THE PREFERRED EMBODIMENTS

Figure 1:
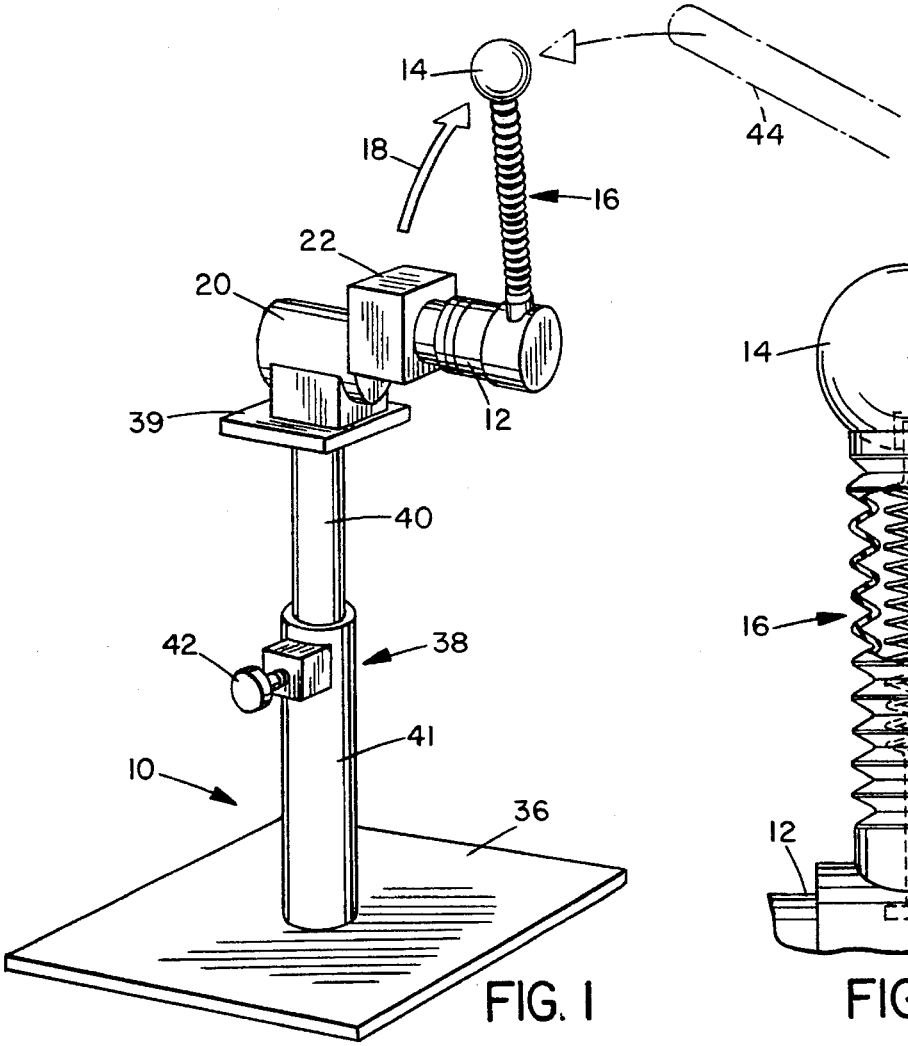
FIG. 1 is a perspective view of a ball hitting practice machine according to a first embodiment of the invention.
Figure 2:
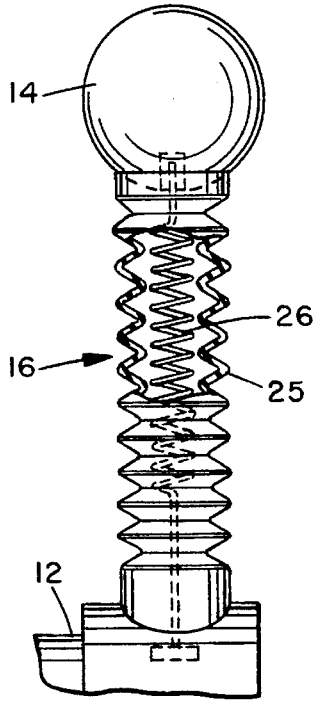
FIG. 2 is an enlarged side elevation view, partially cut away, of a preferred configuration of the ball carrying arm.

FIGS. 1 and 2 illustrate a ball hitting practice machine according to a first embodiment of the present invention. The machine may be used for practice in any game in which a ball is hit or struck by a suitable implement, such as baseball, softball, tennis, racquetball, and the like, but it is particularly designed for baseball or softball hitting practice with a bat. The hitting practice machine basically comprises a support stand 10, a rotating member or shaft 12 rotatably mounted on the support stand 10, and a ball 14 tethered to the rotating arm via a ball carrying arm 16 so as to move in a circular path as indicated by arrow 18 on rotation of shaft 12. Shaft 12 is rotated by drive motor 20 via gearbox 22. Although ball 14 is of conventional round ball-shape in the illustrated embodiment, it will be understood that alternative solid shapes may be used for ball 14, such as square, cylindrical and the like.

The ball carrying arm 16 is illustrated in more detail in FIG. 2. Arm 16 basically comprises an outer flexible hose 25 secured at one end to shaft 12 and secured to ball 14 at its opposite end, and a tension spring 26 extending through the hose and secured to the ball 14 at one end and to shaft 12 at the other end. The ball 14 may alternatively be tethered to the rotating shaft 12 by any other flexible arm which is sufficiently rigid to support the ball, but which will bend to some extent when the ball is struck and subsequently spring back to its normal position projecting transverse to shaft 12. Thus, arm 16 may alternatively be a solid nylon arm having some flexibility. Alternatively, arm 16 may be eliminated and the ball may be carried directly on member 12.

Figure 3:
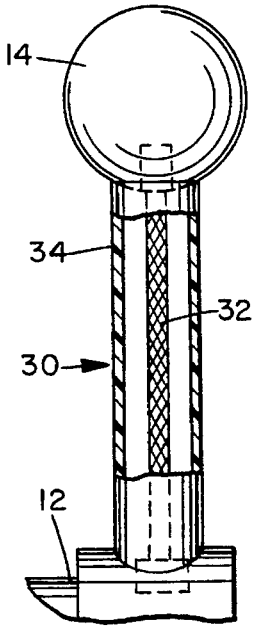
FIG. 3 is a similar view showing an alternative configuration.

FIG. 3 illustrates another embodiment of the ball carrying arm 30. In this embodiment, the ball 14 is tethered to rotatable shaft 12 via a flexible cord 32 of so-called "bungee" material. The cord 32 extends through a rigid outer tube 34 and the ball 14 is held against the outer end of the tube by the cord 32 in the normal position illustrated in FIG. 3.

Stand 10 comprises a flat base 36 and a vertical support shaft 38, with the motor 20 being mounted on a suitable platform 39 at the upper end of shaft 38. Support shaft 38 preferably has two telescoping parts 40,41 which can be secured together at a selected height via locking screw 42, to allow the height of shaft 38 to be adjusted, adjusting the position of the rotating arm 16 to accommodate to players of different height and stance. Base 36 may be made large enough for the player to stand on it, or may be extendible for this purpose. The base may have a downwardly depending spike for securing in the ground, or may have a chamber for filling with sand or water for added stability. The base may be shaped to stand over home plate, with legs for resting on the ground around home plate on a baseball field. The base and drive assembly may be in a housing with only the arm 16 protruding.

In operation, the motor 20 drives the shaft 12 and thus the ball carrying arm 16 in a circular path. The player adopts an appropriate stance and strikes the ball 14, for example with bat 44 as illustrated in FIG. 1, when the ball reaches an appropriate position. When the ball is struck, the spring 26 and hose 25 will bend and the ball will be propelled a short distance away from the bat, and the hose and spring will subsequently spring back into an upright or normal position in which the arm 16 projects transversely away from shaft 12, ready to be struck again when an appropriate position in the travel path is reached.

In the version of FIG. 3, the ball is not secured to tube 34. Thus, when the ball is struck it will be propelled away from rigid tube 34 to an extent permitted by the stretching of flexible cord 32. The cord will subsequently pull the ball back into the position illustrated in FIG. 3, ready to be struck again at the appropriate position in the travel path. Thus, in the version of FIG. 2 the ball does not travel away from the moving, ball carrying arm, whereas in FIG. 3 the ball has limited travel away from carrying arm or tube 34.

In all of the illustrated embodiments, the ball carrying arm 16 is at least partially resilient to absorb shock when the ball is struck. However, the shock absorbing characteristics may be provided elsewhere, for example in movable arm 12, or may be built into the drive mechanism, via a shock absorbing clutch. Alternatively, the support shaft 38 may be resilient.

In the embodiment illustrated in FIGS. 1–3, the ball is driven in a circular path about a horizontal axis which is vertically adjustable by adjusting the length of support shaft 38. The ball may be driven at a single speed, multiple set speeds, or at a variable speed. The motor is preferably reversible so that the machine may be used by right or left handed batters, although it may be non-reversible, with different-handed batters batting from opposite sides.

The length of the ball carrying arm may also be adjustable to allow the radius of the ball swing or travel path to be varied. This may be achieved, for example, by replacing tube 34 of FIG. 3 with a telescopically adjustable arm having inner and outer tubes which are telescopically engaged in an equivalent manner to support shaft 38. The adjustable length ball carrying arm may be adjusted manually or automatically, and in the latter case the length may be varied during the ball swing so that the ball path is unpredictable, requiring close attention by the player to hit the ball properly.

Although the ball travels in a full circular path in the illustrated embodiments, it may alternatively be arranged by a suitable drive mechanism to travel in a partial circular path, or other paths such as oblong, square, rectangle or the like. An unpredictable or random path may be introduced by means of a cam mechanism or the like in the drive linkage to vary the plane of the ball swing path.

Figure 4:
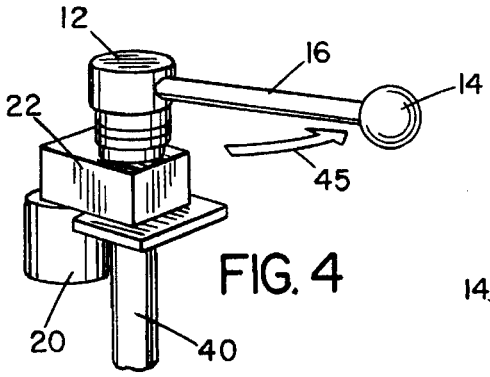
FIG. 4 is a perspective view of an alternative horizontally swinging drive head.

In the embodiment of FIG. 1, the ball is arranged to travel in a circular path in a vertical plane. However, the ball carrying arm may alternatively be oriented horizontally, as illustrated in the alternative of FIG. 4. The components of the machine in FIG. 4 are identical to that of FIG. 1, apart from the orientation of various parts, and like reference numerals have been used for like parts as appropriate. Thus, in FIG. 4, rotatable shaft 12 is orientated vertically rather than horizontally, and rotates about a vertical axis, and arm 16 therefore projects horizontally and rotates in a horizontal plane in the direction of arrow 45. As in the previous embodiment, shaft or hub 12 is driven by motor 20 which is suitably supported in the appropriate orientation on platform 39. In this embodiment, as in the first embodiment, the player simply stands at the appropriate position in order to be able to strike the ball at some point in its path.

In another alternative, an adjustable knuckle joint may be provided in the support shaft to allow adjustment of member 12 between the horizontal orientation of FIG. 1 and the vertical orientation of FIG. 4, and other angular orientations between those extremes.

Any suitable motor 20 may be used to drive the ball carrying arm, for example an electrical, wind-up, gasoline, or any other type of powered motor. The motor may be located as illustrated or on the base, and may drive the arm directly or indirectly, via a friction drive, belt, gears or a flexible drive cable or shaft. The machine may be used for practicing any type of ball game in which a ball is struck by an implement such as a club, racket or the like, and the appropriate type of ball for any sport may be carried by arm 16.

The machine may be designed to drive more than one ball, so that two or more players could practice at the same time. For example, a horizontal drive shaft could carry balls on arms at each end, as illustrated in dotted outline in FIG. 1.

Figure 5:
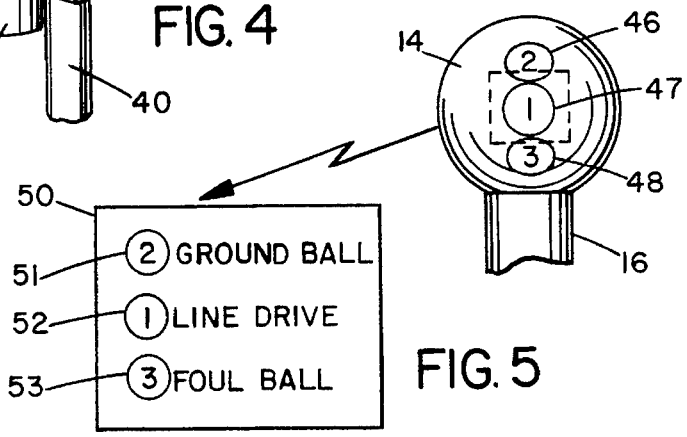
FIG. 5 illustrates a ball with striking zone sensors and a remote indicator.

The ball may have embedded sensors, for example pressure sensors or transducers 46,47,48 as illustrated in FIG. 5, to monitor the accuracy of a player's hits via suitable detector circuitry 50. Suitable indicators such as light emitting diodes 51,52,53 are lit on actuation of sensor 46,47 or 48, respectively. In the case of baseball or softball practice, a dead center hit on the ball will result in a line drive while a ball hit above center results in a ground ball and a ball hit below center results in a foul ball. If the ball is hit dead center, sensor 47 will be actuated and a "line drive" indication will be given by circuitry 50. Sensor 46 detects above center hits while sensor 48 detects below center hits. The sensors may also be arranged to provide an indication of the power or force imparted by the hit, and thus how far the ball would have been propelled in a normal play situation.

The machine may be incorporated with a computer controlled, custom pitching program which is programmable to match any pitching style for real-time professional batter warm-ups. The computer output will control the motor 20, and the length of the ball-carrying arm in a case where the arm is adjustable, in order to vary the speed and direction of the ball in accordance with stored program instructions. The machine may be used in an interactive video set-up. The player may use a video or a mirror for stance and swing feedback. The player may have control of the ball speed or path, or both, via remote switches and sensors in the bat handle or in a foot plate controller.

The simplicity of the hitting practice machine in its basic form makes it relatively inexpensive and easy to use. It can be used by the player alone and does not require the presence of two or more persons to retrieve loose balls, for example. It does not have to be used in any special area but only requires a small space to be operated effectively, since the ball is not propelled away from the machine or is only propelled a small, controlled distance. Thus, it can be used at home, indoors or out, increasing the amount of time in which a player can effectively practice hitting the ball.

Although some preferred embodiments of the invention have been described above by way of example only, it will be understood by those skilled in the field that modifications may be made to the disclosed embodiments without departing from the scope of the invention, which is defined by the appended claims.

I claim:

1. A baseball hitting practice machine, comprising:

a movable member;

means attaching a ball to said movable member; and drive means for driving said movable member to move said attaching means and said ball in a complete circular path extending in a vertical plane, whereby a player can strike the ball at a selected point in the path.

2. The machine as claimed in claim 1, including resilient shock absorbing means for absorbing shock when a player strikes the ball.

3. The machine as claimed in claim 1, wherein said movable member is an elongated horizontally extending shaft and said means attaching is a ball carrying arm secured at one end to said movable member and having an outer end, the ball being carried on the outer end of the arm.

4. The machine as claimed in claim 3, wherein the arm is at least partially resilient.

5. The machine as claimed in claim 4, wherein the ball carrying arm is resilient.

6. The machine as claimed in claim 5, wherein the resilient arm is a spring.

7. The machine as claimed in claim 6, wherein the ball carrying arm further comprises a resilient hose through which said spring extends, the hose having a first end secured to said movable member and an outer end, the ball being secured to the outer end of said spring and hose.

8. The machine as claimed in claim 2, wherein the ball carrying arm comprises a rigid tube having a first end secured to said movable member and an outer free end, and a flexible cord extending through said rigid tube, the cord having a first end secured to said movable member and a second end secured to said ball, said cord being functional to hold said ball against the outer end of said tube in a first position.

9. The machine as claimed in claim 1, including a support stand for supporting said movable member at a selected height.

10. The machine as claimed in claim 9, wherein said support stand is adjustable to adjust the height of said movable member.

11. The machine as claimed in claim 1, wherein said ball has sensors at selected positions for sensing impact on the ball at that position and for providing an output on impact, and detector means for detecting the sensor outputs.

12. A baseball hitting practice machine, comprising:

a horizontal oriented drive shaft rotatable about a horizontal axis of rotation;

an elongate ball carrying member having a first end secured to said drive shaft and a second end, said ball carrying member extending transversely from said axis of rotation;

a ball carried on the second end of said ball carrying member; and drive means for driving said drive shaft to rotate about said horizontal axis and move said ball in a predetermined path lying in a vertical plane, whereby a player can strike the ball at a selected point in the path.

* * * * *